United States Patent [19]

Downey, Jr.

[11] 4,436,136

[45] Mar. 13, 1984

[54] INSULATED SLAT

[75] Inventor: Robert C. Downey, Jr., Columbus, Ohio

[73] Assignee: Harsco Corporation, Camp Hill, Pa.

[21] Appl. No.: 333,805

[22] Filed: Dec. 23, 1981

[51] Int. Cl.[3] ..... A47H 1/13

[52] U.S. Cl. ..... 160/232; 160/236

[58] Field of Search ..... 160/220, 232, 235, 236

[56] References Cited

U.S. PATENT DOCUMENTS

| | | | |
|---|---|---|---|
| 546,858 | 9/1895 | Kinnear . | |
| 675,953 | 6/1901 | Kinnear . | |
| 675,954 | 6/1901 | Kinnear . | |
| 1,013,945 | 1/1912 | McCloud . | |
| 1,352,656 | 9/1920 | Cahill . | |
| 1,707,287 | 3/1929 | Sudzki | 160/235 |
| 2,039,447 | 5/1936 | Pixley . | |
| 3,481,386 | 12/1969 | Smart . | |
| 3,511,301 | 5/1970 | Graham et al. . | |
| 3,772,129 | 11/1973 | Dover . | |
| 3,941,180 | 3/1976 | Thill . | |
| 4,037,639 | 7/1977 | Jones . | |
| 4,183,393 | 1/1980 | Bailey . | |

FOREIGN PATENT DOCUMENTS

| | | | |
|---|---|---|---|
| 2109838 | 9/1972 | Fed. Rep. of Germany | 160/236 |
| 2808177 | 8/1979 | Fed. Rep. of Germany | 160/232 |
| 2912774 | 10/1980 | Fed. Rep. of Germany | 160/235 |
| 2925635 | 1/1981 | Fed. Rep. of Germany | 160/232 |

OTHER PUBLICATIONS

Kinnear Bulletin No. 219, *Kinnear Rolling Doors and Grilles,* pp. 4, 5 and 9.

*Primary Examiner*—Peter M. Caun

*Attorney, Agent, or Firm*—Kerkam, Stowell, Kondracki & Clarke

[57] ABSTRACT

A slat assembly for a door includes a steel slat for the outside of the door and an extrusion of polyvinylchloride (PVC) serving as an insulation cover. A cavity in between the slat and the insulation cover is filled with insulation, the insulation and insulation cover providing a thermal break between the outside steel slats and the inside. The insulation cover is uniquely shaped to maximize strength and to secure it indirectly by way of a steel clip to the steel slat such that stress is minimized by accomodating differing coefficients of thermal expansion.

17 Claims, 6 Drawing Figures

INSULATED SLAT

BACKGROUND OF THE INVENTION

1. Field of the Invention

The present invention relates to sectional doors. More specifically, it relates to sectional doors comprising a plurality of insulated panel sections which pivot relative to each other, allowing the door to be moved along a track from a vertical closed position to a rolled up position at the top of the door.

2. Background of the Prior Art

The use of sectional doors is well known. Such doors may be designed for rolling the sections or slats into a so-called "curtain coil" adjacent the top of the door. Such sectional doors are often used for truck unloading docks at warehouses or similar industrial facilities.

Since such sectional doors are generally exposed to rain, snow, wind, and sun, it is generally desirable to make these out of materials which are resistant to wear caused by these elements. Accordingly, steel, aluminum, and similar substances are often used for such sectional doors. However, such weather resistant substances are disadvantageous in that they are good thermal conductors. The high thermal conductivity of such substances has caused the loss of heat from inside the warehouse or similar facility.

In order to counter this loss of heat, various types of insulated slats or door sections have heretofore been made. However, the use of such insulated door sections has often required the complete redesign of the door itself in addition to the track in which it slides. In addition, such insulated door sections often require difficult and/or time consuming techniques for installing the insulation. On the other hand, if the installing of the insulation is made easy by the design, insulation may be lost from the door as by breaking of solid insulation or leakage of fiber insulation.

Prior art insulated door sections or slats have additionally been subject to problems caused by the differing thermal expansion of the outside weather resistant portion (e.g. metal or aluminum) of the door and the insulation. For example, if foamed polystyrene is used as an insulation and is bonded to a steel or metallic front face of a door, a change in temperature will expand the polystyrene and the front portion of the door at differing rates, thereby tending to sever the bond between the polystyrene and the front section.

SUMMARY OF THE INVENTION

Accordingly, it is an object of the present invention to provide a novel and improved sectional door having insulated door sections or slats and which may be used without extensive redesign of the systems and assemblies previously used for the uninsulated models.

A further object of the present invention is to provide a sectional door wherein insulation may be easily installed, but is secure against loss due to insulation breakage, leakage, or the like.

Yet another object of the present invention is to provide an insulated sectional door wherein the differing rates of thermal expansion of the insulation and other parts of the door section are readily accommodated without any deleterious effects.

A still further object of the present invention is to provide an insulation cover assembly which may be easily mounted to a door slat.

Yet another object of the present invention is to provide an insulated slat or door section providing for a substantially complete thermal break between the weather resistant steel or metallic front piece and the inside of the warehouse or similar facility.

A still further object of the present invention is to provide an insulated door section which provides high strength, relative simplicity in design, ease and low cost in construction, and great efficiency in insulating.

These and other objects of the present invention which will become apparent as the description proceeds are realized by a sectional door including at least a first slat assembly and a second slat assembly. Each slat assembly comprises a slat including a generally planar side portion having an interior surface on one side and an exterior surface on the other side, an upper end curved portion, and a lower end curved portion, and an insulation cover including a generally planar side portion having an interior surface facing towards the first piece and an exterior surface facing away from the first piece, an upper end curved portion disposed at least partially around the upper end curved portion of the first piece, a generally planar upper end transverse portion extending from the side portion of the insulation cover to the side portion of the slat, and a generally planar lower end transverse portion extending from the side portion of the insulation cover to the side portion of the slat. Each slat assembly further includes insulation disposed in a cavity between the side portion of the slat and the side portion of the insulation cover, the cavity further bounded by the upper transverse portion and the lower transverse portion. The lower curved portion of the first slat assembly is disposed within the upper curved portion of the slat of the second slat assembly for relative rotation between the first and second slat assemblies. Preferably, the slat is made of metal and the insulation cover is an extrusion of polyvinylchloride or similar plastic.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments of the present invention taken in conjunction with the accompanying drawings wherein like reference characters represent like parts throughout the several views.

DETAILED DESCRIPTION OF THE INVENTION

Figure 1:
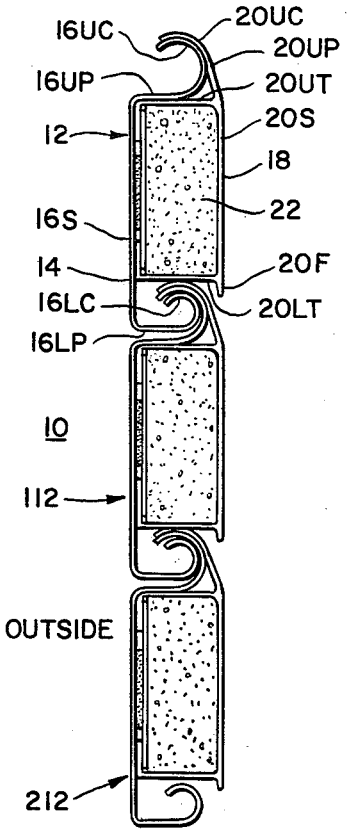
FIG. 1 shows a side view of a sectional door according to the present invention.

Turning initially to FIG. 1, there is shown a sideview of a door 10 according to the present invention. The door 10 comprises first, second, and third slat assemblies 12, 112, and 212. It will be readily appreciated that in actual practice a door according to the present invention will usually have more than three slat assemblies.

Each of the slat assemblies 12, 112, 212 will be constructed identically. Accordingly, the details of slat assembly 12 will be discussed, it being understood that the other slat assemblies are constructed in likewise fashion. Slat assembly 12 includes a slat 14, preferably made of steel although aluminum or other weather resistant metals may also be used. Slat 14 includes a generally planar side portion 16S, an upper plane portion 16UP perpendicular to the side portion 16S, an upper end curved portion 16UC, a lower end plane portion 16LP perpendicular to side portion 16S, and a lower end curved portion 16LC. As used throughout this application, generally planar shall be interpreted to mean that the side portion 16S (or other portion so described) defines a plane which might include decorative ridges, moulding, or other slight variations from a plane. The slat as shown is slat No. 14 sold by the Kinnear Division of Harsco Corporation, assignee of the present invention, and is described at page 5 of Kinnear bulletin No. 219, "Rolling doors and grills", hereby incorporated by reference.

Slat assembly 12 further includes an extruded insulation cover 18 preferably made of rigid polyvinylchloride (PVC). Insulation cover piece 18 includes a generally planar side portion 20S and, separated from side portion 20S by an upper planar portion 20UP, is an upper end curved portion 20UC disposed at least partially around the upper end curved portion 16UC of the slat 14. Insulation cover piece 18 further includes a generally planar upper end transverse portion 20UT extending perpendicularly from the side portion 20S to the side portion 16S of the slat 14 and a generally planar lower end transverse portion extending perpendicularly from the side portion 20S to side portion 16S of the slat 14. The side portion 20S is parallel to side portion 16S of slat 14.

By making upper curved portion 20UC and upper transverse portion 20UT of insulation cover 18 accommodate upper curved portion 16UC and upper planar portion 16UP of slat 14 in the manner shown, the insulation cover 18 will be strongly secured to slat 14. Lower transverse portion 20LT will likewise help insulation cover 18 resist being accidentally pulled off slat 14.

Insulation 22, which may be expanded polystyrene foam, fiberglass or urethane foamed in place, is disposed in the cavity between the side portion 16S of slat 14 and the side portion 20S of the insulation cover 18. The cavity having insulation 22 is further bounded by the upper transverse portion 20UT and the lower transverse portion 20LT.

As shown in FIG. 1, the upper and lower curved portions 16UC and 16LC of slat 14 and upper curved portion 20UC are disposed vertically in line with the insulation containing cavity. Vertically in line refers to above and below the cavity when the slat assembly 12 is disposed in a vertical position as when door 10 is closed.

Continuing to view FIG. 1, but also considering the exploded view of FIG. 2 and the perspective of FIG. 3, the details of the interface between insulation 22 and side portion 16S of slat 14 will be discussed. Adhesive 26 is used to secure a clip 24A, preferably made of steel or other metal, to the interior surface of side portion of 16S of slat 14. It will be readily appreciated that side portion 16S has an interior surface facing towards insulation 22 and an exterior surface facing away from the insulation. The clip 24A will hold the insulation cover 18 to the slat 14 by reason of the upper and lower lip 20UL and 20LL respectively extending perpendicularly at the ends of upper and lower transverse portion 20UT and 20LT. As shown in FIG. 1, the clip is trapped behind the lips 20UL and 20LL.

Figure 4:
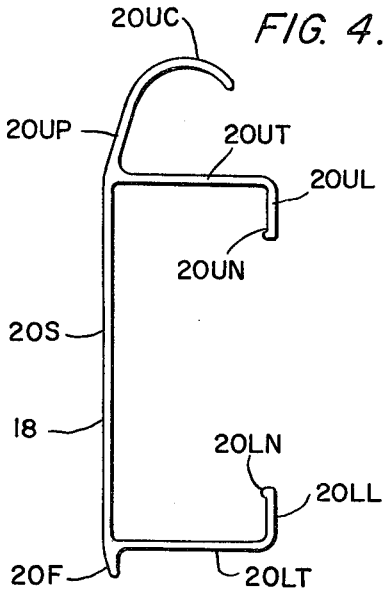
FIG. 4 shows a sideview of an insulation cover according to the present invention.

Continuing to view the previous figures and also considering FIG. 4, which shows a side view of the insulation cover 18 of the present invention, the details of the extruded PVC insulation cover 18 will be discussed. In order to properly accommodate the different thermal expansion of the insulation 22 and the steel or metallic slat 14, no adhesion bonds are made between the insulation 22 and the interior surface of side portion 16S of slat 14. Instead, the insulation 22 is compressed fit and steel clip 24A is used to hold the cover 18 to the slat 14. Lips 20UL and 20LL on the insulation cover 18 include upper and lower nibs 20UN and 20LN such that steel clip 24 may move relative the the upper and lower lips 20UL and 20LL to minimize stress caused by the differing coefficients of thermal expansion of the insulation 22, PVC insulation cover 18, and steel slat 14.

Figure 2:
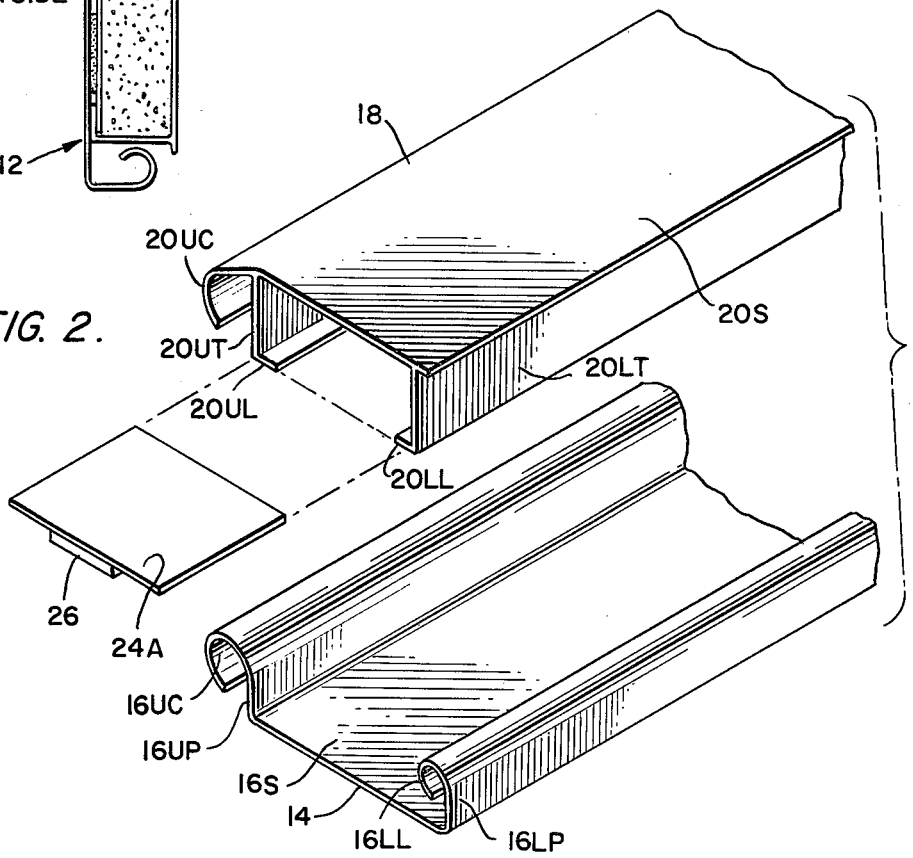
FIG. 2 shows an exploded view of a single door section or slat assembly according to the present invention.

Flange 20F may extend below side portion 20S at an angle of 10° (FIG. 4) or may simply be planar with 20S (FIGS. 1 and 2). In either case, flange 20F may function as a stop to prevent slat assembly 12 from being rotated too far clockwise (FIG. 1) relative to slat assembly 112. Lower planar portion 16LP and upper planar portion 16UP will serve as stops to prevent counterclockwise rotation (FIG. 1) of one slat assembly relative to another.

It should be noted that steel clip 24A is preferably one of a number of steel clips including also 24B and 24C which may be placed along the width of the slat assemblies such as 12. This will secure the insulation cover 18 to the slat 14 at various points along the length. In addition, in order to prevent the insulation cover 18 from sliding lengthwise relative to the slat 14, it is preferable to have the center clip 24B, shown with the insulation cover 18 and insulation 22 broken away in FIG. 3, adhered to the upper and/or lower lips 20UL and 20LL as well as being adhered to the interior surface of side portion of slat 14. Inasmuch as the steel clips 24A and 24C are adhered only to the steel slat 14, the insulation cover 18 may flex relative to the slat 14 as when the insulation expands all along the length of the interface except at center clip 24B.

Figure 3:
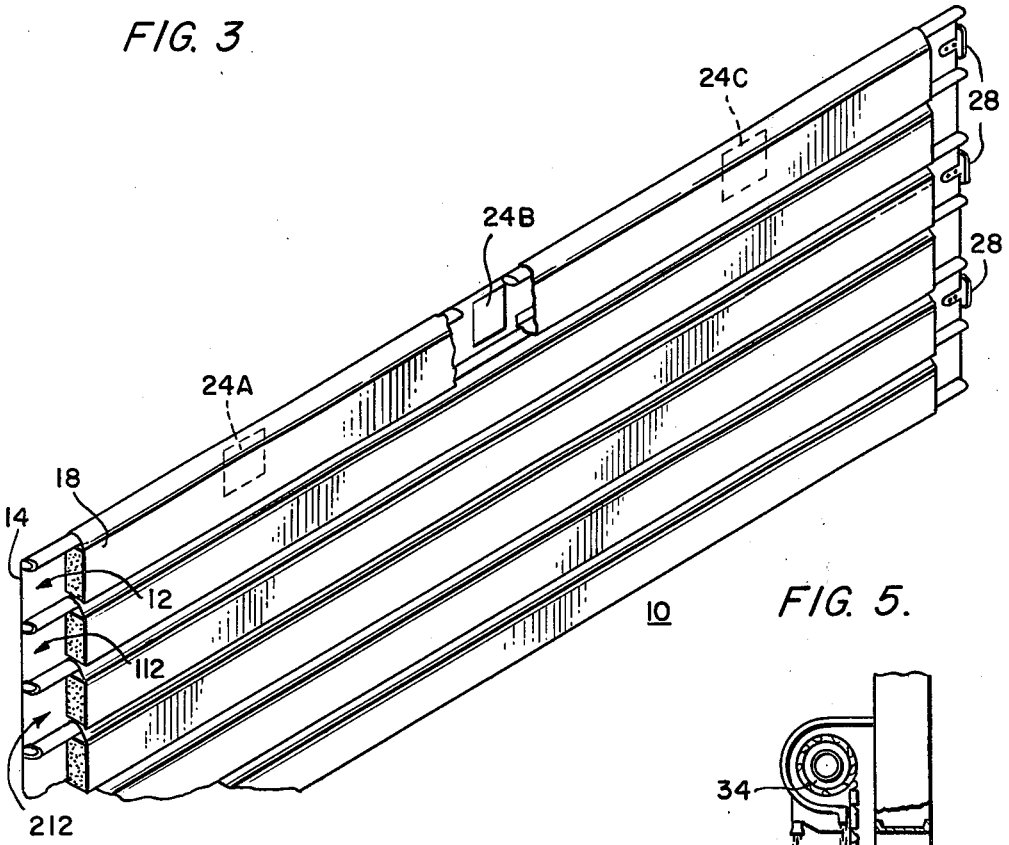
FIG. 3 shows a perspective view of a sectional door of the present invention.
Figure 5:
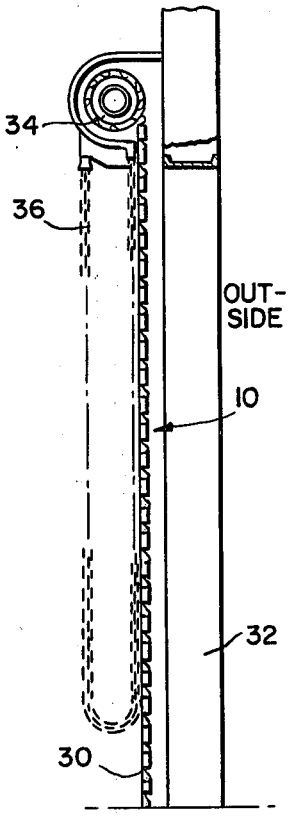
FIG. 5 shows a sideview illustrating the track assembly used for the present invention.
Figure 6:
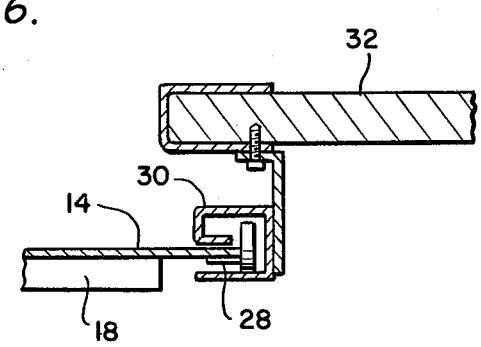
FIG. 6 shows in cross-sectional view the guide track used for the present invention and a door section according to the present invention.

Considering now FIGS. 3, 5, and 6, the movement of door 10 will presently be discussed. As shown in FIG. 3, every other slat assembly may include an end lock 28 which may be used to secure the door 10 to a guide track 30. Alternately, each slat assembly 12 could include an end lock 28 at both ends. For simplicity, no end locks 28 are shown at the left side of FIG. 3, although in actual practice the end locks would be disposed at both ends of the door 10. FIG. 6 shows a cross-sectional view looking directly down towards a wall 32 with a guide track 30 mounted thereupon. The end lock 28 which may be riveted to slat 14 cooperates with guide track 30 in a manner well known in the art. As shown in FIG. 5, the door 10 may move up guide track 30 to a coiled position around core 34 by manual operation of chain 36 or, alternately, by using a motor (not shown) to drive core 34. The details of the guide track 30, core 34, and chain 36 need not be discussed in detail, it being noted that these features are well known in the art. The details of door 10 are, of course, not visible in FIG. 5. However, it should be readily appreciated that the structure of applicant's invention allows one to use these heretofore known components for an insulated door without requiring any adaptions to the guide track, core, and associated parts.

The method of assembling the insulated slat will presently be discussed. The portions 20UT and 20LT of insulation cover 18 are spread apart such that lips 20UL and 20LL may be cleared by insulation 22 which is inserted from the back (e.g. opposite side 20S) into the cavity bounded by side portion 20S, upper transverse portion 20UT, lower transverse portion 20UL, upper lip 20UL, and lower lip 20LL. The insulation cover 18 is preferably an extrusion of PVC and is sufficiently flexible to allow this spreading. The steel clips 24A, 24B, and 24C are likewise inserted by spreading portions 20UT and 20LT and lips 20UL and 20LL. The insulation 22 and steel clips 24A, 24B, and 24C are compression fit into the cavity. Either before or after the insertion of steel clips 24A, 24B, and 24C, adhesive 26, which is preferably a thermoplastic synthetic rubber base double-sided adhesive sheet or tape, is mounted to the steel clips. If the center clip 24B is to be bound to insulation cover 18, the adhesive tape 26 may be placed vertically on the center clip 24B to adhere to lips 20UL and 20LL upon insertion of the clip 24B into the insulation cover 18.

The insulation cover 18, insulation 22, adhesive 26, and steel clips 24A, 24B and 24C together comprise an insulation cover assembly. Release paper (not shown) may be used on the adhesive tape 26 to keep it from bonding prior to its bonding to slat 14.

The insulation cover assembly may be snapped onto the slat 14 with portion 20UC of insulation cover 18 pushed over and snapped to curved portion 16UC. As shown in FIG. 1, the curvature of curved portion 20UC will hold it around the slat curved portion 16UC once it is snapped into place. This may be done from the interior surface of side portion 16S of slat 14 without removing the slat 14 from track 30. The insulation cover assembly may be slid sideways until properly placed horizontally in the slat 14. Insulation cover 18 and assembly may then be rotated up (20UC rotating about 16UC whereupon the release paper (not shown) may be removed from the adhesive tape 26 and the insulation cover assembly pushed towards the slat 14 to complete the assembly by bonding clips 24A, 24B, and 24C to slat 14.

Although specific materials and structures have been disclosed in the present application, it is to be appreciated that these are for illustrative purposes. Numerous modifications and adaptations will be readily apparent to those of ordinary skill in the art. Accordingly, the scope of the present invention should be determined with reference to the appended claims.

What is claimed is:

1. A door including at least a first slat assembly and a second slat assembly, each slat assembly comprising:

(a) a slat including (i) a generally planar side portion having an interior surface on one side and an exterior surface on the other side, (ii) an upper end curved portion, (iii) a lower end curved portion;

(b) an insulation cover piece including (i) a generally planar side portion having an interior surface facing towards said slat and an exterior surface facing away from said slat, (ii) an upper end curved portion disposed at least partially around said upper end curved portion of said slat, said upper end curved portion of said cover piece held to said upper end curved portion of said slat by its curvature around said upper end curved portion of said slat, (iii) a generally planar upper end transverse portion extending from said side portion of said insulation cover to said side portion of said slat, and (iv) a generally planar lower end transverse portion extending from said side portion of said insulation cover to said side portion of said slat; and (c) insulation disposed in a cavity between said side portion of said slat and said side portion of said insulating cover, said cavity bounded by said upper transverse portion and said lower transverse portion; and wherein said lower end curved portion of said slat of said first slat assembly is disposed at least partially within said upper curved portion of said slat of said second slat assembly for relative rotation between said first and second slat assemblies.

2. The door of claim 1 wherein, for each slat assembly, said upper and lower curved portions of said slat and said upper curved portion of said insulation cover are disposed vertically in line with said cavity.

3. The door of claim 1 wherein, for each slat assembly, said slat includes an upper planar portion between its side portion and its upper curved portion and said upper planar portion is parallel to and just above said upper transverse portion of said insulation cover.

4. The door of claim 1 wherein, for each slat assembly, said insulation cover includes an upper lip on said upper transverse portion and a lower lip on said lower transverse portion and each slat assembly further includes a generally planar clip secured to said interior surface of said side portion of said slat with said upper and lower lips trapped in between said generally planar clip and said side portion of said slat, and said insulation is disposed between said clip and said interior surface of said side portion of said insulation cover.

5. The door of claim 4 wherein, for each slat assembly, said upper and lower curved portions of said slat and said upper curved portion of said insulation cover are disposed vertically in line with said cavity and said slat includes an upper planar portion between its side portion and its upper curved portion and said upper planar portion is parallel to and just above said upper transverse portion of said insulation cover.

6. The door of claim 1, 3, and 4 wherein each slat is made of metal and each insulation cover is made of plastic.

7. The door of claim 1, 3, or 4 wherein each slat is made of steel and each insulation cover is an extrusion of polyvinylchloride.

8. An insulation cover assembly for insulating a slat of a door comprising:

(a) an insulation cover including (i) a generally planar side portion having an interior surface and an exterior surface, (ii) an upper curved portion adapted to be disposed at least partially around a curved portion of a slat, (iii) generally planar upper and lower transverse portions extending from said side portion, (iv) upper and lower lips respectively disposed at ends of said upper and lower transverse portions, (b) insulation disposed in the cavity between said side portion, said upper and lower transverse portions, and said upper and lower lips, and (c) a clip extending from the upper lip to the lower lip at least partially in between said insulation and said upper and lower lips, and further including means to secure a flat portion of said clip to a flat portion of a slat.

9. The insulation cover assembly of claim 8 wherein said means to secure includes adhesive tape bound to said clip.

10. The insulation cover assembly of claim 8 wherein said clip is a generally planar steel clip.

11. The insulation cover assembly of claim 8 wherein said insulation cover is made of plastic.

12. The insulation cover assembly of claim 8 wherein said insulation cover is an extrusion of PVC.

13. A method of assembling a slat assembly having:

(1) a slat including (i) a generally planar side portion having an interior surface on one side and an exterior surface on the other side, (ii) an upper end curved portion, and (iii) a lower end curved portion; and (2) an insulation cover assembly including an insulation cover with (i) side portion having an interior surface and an exterior surface, (ii) an upper curved portion adapted to be disposed at least partially around a curved portion of a slat, and (iii) generally planar upper and lower transverse portions extending from said side portion;

the method steps comprising:

(a) snapping the upper end curved portion of the insulation cover over the upper end curved portion of the slat such that the upper end curved portion of the cover piece is held to the upper end curved portion of the slat by its curvature around the upper end curved portion of the slat, and (b) securing said insulation cover assembly against sideways sliding relative to said slat.

14. The method of claim 13 wherein said securing step comprises adhering the insulation cover assembly to the slat.

15. The method of claim 13 wherein said securing step is accomplished with said slat in place as one of a plurality of connected slats in a door track.

16. The method of claim 13 wherein said insulation cover further includes upper and lower lips respectively disposed at ends of said upper and lower transverse portions, said insulation cover assembly further includes insulation and a plurality of planar clips and, prior to the snapping step, said lips are spread apart and:

insulation is inserted from the interior surface side of said insulation cover into a cavity between said side portion of said insulation, said upper and lower transverse portions, and said upper and lower lips, and a plurality of planar clips are inserted into the cavity; such that said planar clips and said insulation are compression fit in said cavity.

17. The method of claim 16 wherein said securing step comprises adhering said planar clips to said slat.

* * * * *